US009343855B2

(12) United States Patent
Wei

(10) Patent No.: US 9,343,855 B2
(45) Date of Patent: May 17, 2016

(54) COAXIAL CABLE CONNECTOR

(71) Applicant: EZCONN CORPORATION, Taipei (TW)

(72) Inventor: Kai-Chih Wei, Taipei (TW)

(73) Assignee: EZCONN CORPORATION, Taipei (TW)

( * ) Notice: Subject to any disclaimer, the term of this patent is extended or adjusted under 35 U.S.C. 154(b) by 6 days.

(21) Appl. No.: 14/093,077

(22) Filed: Nov. 29, 2013

(65) Prior Publication Data

US 2015/0024627 A1 Jan. 22, 2015

(30) Foreign Application Priority Data

Jul. 19, 2013 (TW) ..... 102213640 U

(51) Int. Cl.

| | |
|---|---|
| ***H01R 24/40*** | (2011.01) |
| ***H01R 13/6581*** | (2011.01) |
| ***H01R 9/05*** | (2006.01) |
| ***H01R 13/622*** | (2006.01) |

(52) U.S. Cl.

CPC ..... *H01R 24/40* (2013.01); *H01R 13/6581* (2013.01); *H01R 9/05* (2013.01); *H01R 9/0521* (2013.01); *H01R 9/0524* (2013.01); *H01R 13/622* (2013.01)

(58) Field of Classification Search

CPC ..... H01R 9/05; H01R 9/0527
USPC ..... 439/578, 322, 581–585
See application file for complete search history.

(56) References Cited

U.S. PATENT DOCUMENTS

| | | | | |
|---|---|---|---|---|
| 6,712,631 | B1 | 3/2004 | Youtsey | |
| 7,114,990 | B2 | 10/2006 | Bence et al. | |
| 7,479,035 | B2 | 1/2009 | Bence et al. | |
| 7,566,236 | B2 | 7/2009 | Malloy et al. | |
| 7,674,132 | B1 | 3/2010 | Chen | |
| 7,806,725 | B1 | 10/2010 | Chen | |
| 7,824,216 | B2 | 11/2010 | Purdy | |
| 7,892,024 | B1 * | 2/2011 | Chen | 439/578 |
| 8,192,237 | B2 * | 6/2012 | Purdy | H01R 9/0524 439/584 |
| 8,287,320 | B2 | 10/2012 | Purdy et al. | |
| 2006/0166552 | A1 * | 7/2006 | Bence et al. | 439/578 |
| 2008/0102696 | A1 | 5/2008 | Montena | |
| 2008/0311790 | A1 | 12/2008 | Malloy et al. | |
| 2010/0081321 | A1 * | 4/2010 | Malloy et al. | 439/578 |
| 2010/0135181 | A1 | 6/2010 | Earnshaw et al. | |
| 2010/0297875 | A1 | 11/2010 | Purdy et al. | |
| 2011/0008998 | A1 * | 1/2011 | Low et al. | 439/578 |
| 2012/0040537 | A1 * | 2/2012 | Burris | 439/11 |
| 2012/0270441 | A1 | 10/2012 | Bence et al. | |
| 2015/0180141 | A1 * | 6/2015 | Wei | H01R 13/622 439/583 |

* cited by examiner

*Primary Examiner* — James Harvey
*Assistant Examiner* — Oscar C Jimenez

(57) ABSTRACT

A spring has a first resilient tab configured to be radially outward bent at a first angle when the spring is in an expanded position, wherein when a coaxial cable connector is tightly screwed with a threaded connector of an electronic device, an inner flange of a nut of the coaxial cable connector is configured to press the first resilient tab such that the spring is in a contracted position and the first resilient tab is radially between the inner flange and an inner sleeve of the coaxial cable connector, wherein the spring has a plate configured to be arranged between opposing surfaces of an outer flange of the inner sleeve and the inner flange, wherein the plate is integral with the first resilient tab.

20 Claims, 11 Drawing Sheets

COAXIAL CABLE CONNECTOR

The present application claims priority to TW application No. 102213640, filed on Jul. 19, 2013, all of which is incorporated herein by reference.

BACKGROUND OF THE DISCLOSURE

1. Field of the Disclosure

The disclosure relates to a coaxial cable connector, and more particularly, to a coaxial cable connector with improved electrical connection.

2. Brief Description of the Related Art

Currently, with regards to signal reception, coaxial cables are a mainstream to be employed for televisions (TV). A cable television may receive signals via a coaxial cable. The coaxial cable may include a screw-on F-type connector to be connected with a cable TV decoder, a video cassette recorder (VCR), a digital hard-disk recorder for a digital versatile disc (DVD), a satellite receiver, a video game, a TV signal distribution splitter or a switch.

The conventional screw-on F-type coaxial cable connector may often not have good ground connection because the F-type coaxial cable connector has a nut, when being screwed with a threaded connector, which may have a loose contact with an inner sleeve of the F-type coaxial cable connector. At the same time, the inner sleeve may not contact the threaded connector. This causes the F-type coaxial cable connector and the threaded connector to have unqualified ground connection and electrical signals are also caused to have unqualified properties. The above defects are necessary to be overcome.

SUMMARY OF THE DISCLOSURE

The present invention provides a connector with an electrically conductive spring arranged between a nut and an inner sleeve. The spring has a resilient tab leading the nut to be well connected with the inner sleeve and thus unqualified electrical connection may be avoided.

In an example of the present invention, a coaxial cable connector may include an outer sleeve, an inner sleeve arranged in the outer sleeve and secured with a body of the outer sleeve, wherein the inner sleeve has a first surface between an outer flange of the inner sleeve and the body of the outer sleeve, a spring arranged on the first surface of the inner sleeve, wherein the spring includes a plate, two U-shaped extension portions each substantially vertical to the plate and two resilient tabs connecting with the two U-shaped extension portions respectively, wherein a gap is between the two U-shaped extension portions in an annular direction, wherein the two resilient tab are radially outward bent at a predetermined angle from the two U-shaped extension portions respectively, and a nut arranged around the inner sleeve, wherein the nut is provided with an inner thread and has an inner flange around the spring and the first surface of the inner sleeve, wherein the inner flange of the nut is movable in an axial direction and rotatable in the annular direction over the first surface of the inner sleeve, wherein the inner flange presses the two resilient tabs, when the inner flange of the nut and the outer flange of the inner sleeve have opposing surfaces to contact with each other, such that each of the two resilient tabs is between the inner flange of the nut and the first surface of the inner sleeve.

In an example of the present invention, a spring is configured to be attached to a coaxial cable connector configured to be screwed with a threaded connector of an electronic device, wherein the coaxial cable connector includes an inner sleeve, an outer sleeve coaxially arranged around the inner sleeve and a nut arranged around the inner sleeve, wherein the nut has an inner thread configured to engage with an outer thread of the threaded connector, wherein the inner sleeve has an outer flange configured to be fixed between an inner flange of the nut and the threaded connector of the electronic device, characterized in that: the spring is configured to be arranged around the inner sleeve, wherein the spring has a first resilient tab configured to be radially outward bent at a first angle when the spring is in an expanded position, wherein when the nut is tightly screwed with the threaded connector of the electronic device, the inner flange is configured to press the first resilient tab such that the spring is in a contracted position and the first resilient tab is radially between the inner flange and the inner sleeve, wherein the spring has a plate configured to be arranged between opposing surfaces of the outer flange and the inner flange, wherein the plate is integral with the first resilient tab.

In an example of the present invention, a metal element is configured to be attached to a coaxial cable connector configured to be screwed with a threaded connector of an electronic device, wherein the coaxial cable connector includes an inner sleeve, an outer sleeve coaxially arranged around the inner sleeve and a nut arranged around the inner sleeve, wherein the nut has an inner thread configured to engage with an outer thread of the threaded connector, wherein the inner sleeve has an outer flange configured to be fixed between an inner flange of the nut and the threaded connector of the electronic device, characterized in that: the metal element is configured to be arranged around the inner sleeve, wherein when the nut is tightly screwed with the threaded connector of the electronic device, the metal element has a plate configured to be arranged between opposing surfaces of the outer flange and the inner flange and a first extension portion configured to be radially arranged between the inner flange and the inner sleeve, wherein the plate is integral with the first extension portion.

In an example of the present invention, a spring is configured to be attached to a coaxial cable connector configured to be screwed with a threaded connector of an electronic device, wherein the coaxial cable connector includes an inner sleeve, an outer sleeve coaxially arranged around the inner sleeve and a nut arranged around the inner sleeve, wherein the nut has an inner thread configured to engage with an outer thread of the threaded connector, wherein the inner sleeve has an outer flange configured to be fixed between an inner flange of the nut and the threaded connector of the electronic device, characterized in that: the spring is configured to be arranged around the inner sleeve, wherein when the spring is in an expanded position, the spring has a first resilient tab configured to be radially outward bent at a first angle from a first extension portion of the spring and a second resilient tab configured to be radially outward bent at a second angle from a second extension portion of the spring, wherein the first extension portion is separate in an annular direction from the second extension portion, wherein when the nut is tightly screwed with the threaded connector of the electronic device, the inner flange is configured to press the first and second resilient tabs such that the spring is in a contracted position and the first and second resilient tabs are radially between the inner flange and the inner sleeve.

These, as well as other components, steps, features, benefits, and advantages of the present disclosure, will now become clear from a review of the following detailed description of illustrative embodiments, the accompanying drawings, and the claims.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same reference number or reference indicator appears in different drawings, it may refer to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1:
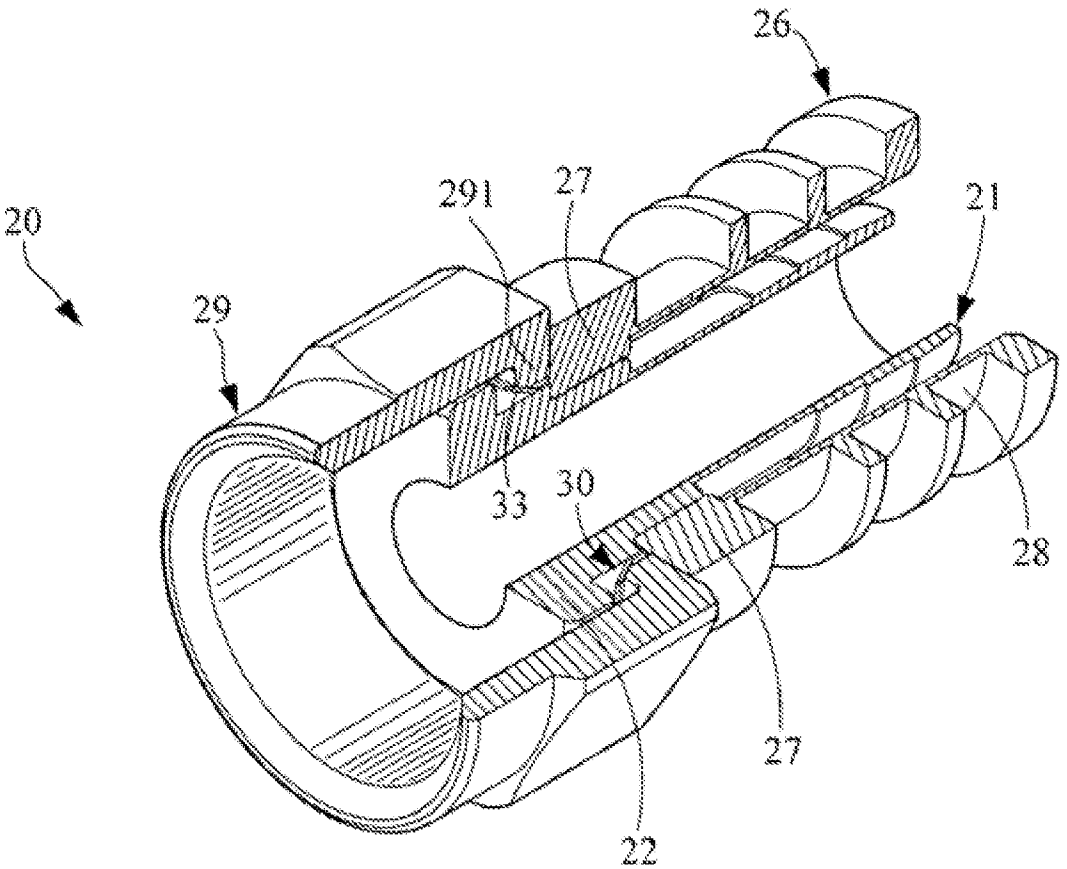
FIG. 1 is a perspective sectional view showing a coaxial cable connector in accordance with a first embodiment of the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

First Embodiment

Figure 2:
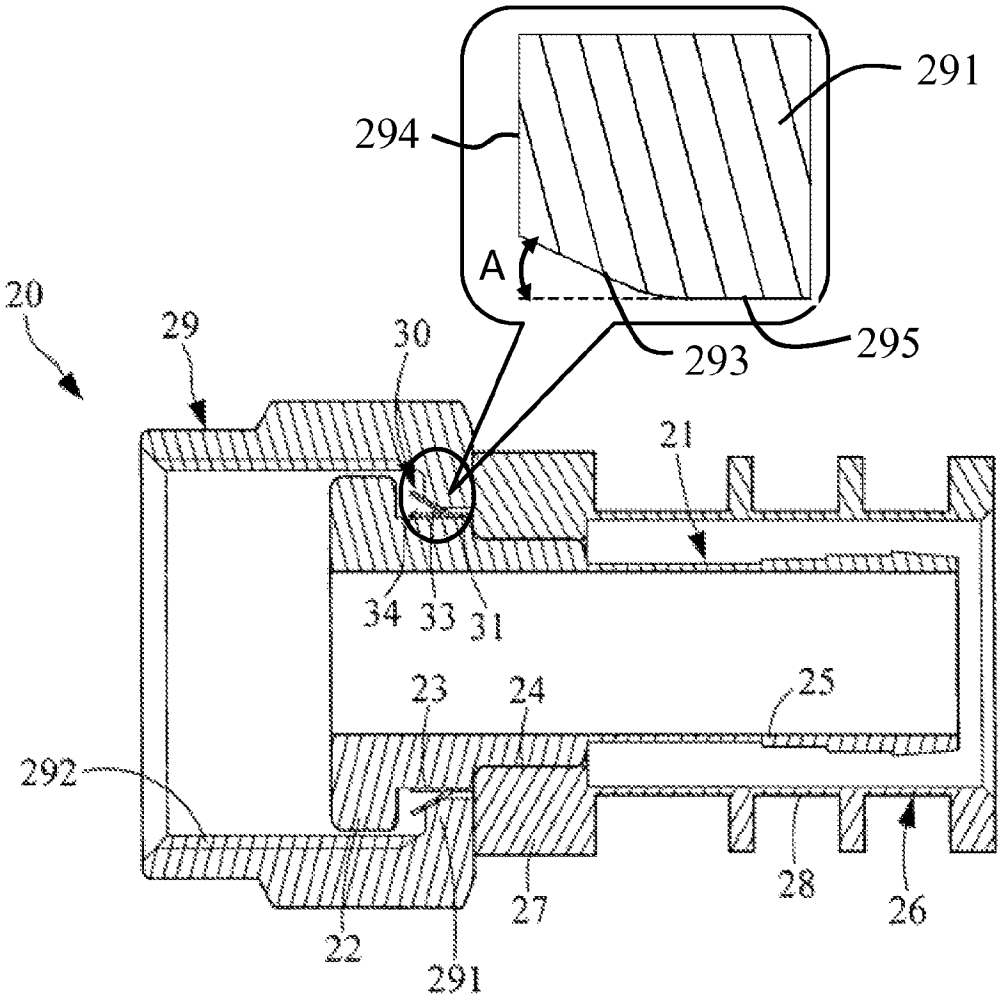
FIG. 2 is a sectional view showing the coaxial cable connector in accordance with the first embodiment of the present invention.

FIG. 1 is a perspective sectional view showing a coaxial cable connector in accordance with a first embodiment of the present invention. FIG. 2 is a sectional view showing the coaxial cable connector in accordance with the first embodiment of the present invention. Referring to FIGS. 1 and 2, the coaxial cable connector 20 includes an inner sleeve 21, an outer sleeve 26 coaxially positioned around the inner sleeve 21, and a conductive grounding spring 30. The inner and outer sleeves 21 and 26 serve to coaxially receive a coaxial cable. Each of the inner sleeve 21, outer sleeve 26 and conductive grounding spring 30 may be made of an electrically conductive material, such as copper (Cu), tin (Sn), iron (Fe), silver (Ag), nickel (Ni), gold (Au), a copper-gold alloy, a copper-tin alloy, a copper-nickel alloy, an electrically-conductive polymer or an electrically-conductive non-metallic material. Each of the inner sleeve 21, outer sleeve 26 and conductive grounding spring 30 may be electroplated, electroless plated or coated with an antirust metal layer that may be made of an electrically conductive material, such as copper (Cu), tin (Sn), iron (Fe), silver (Ag), nickel (Ni), gold (Au), a copper-gold alloy, a copper-tin alloy, a copper-nickel alloy, an electrically-conductive polymer or an electrically-conductive non-metallic material.

Figure 3:
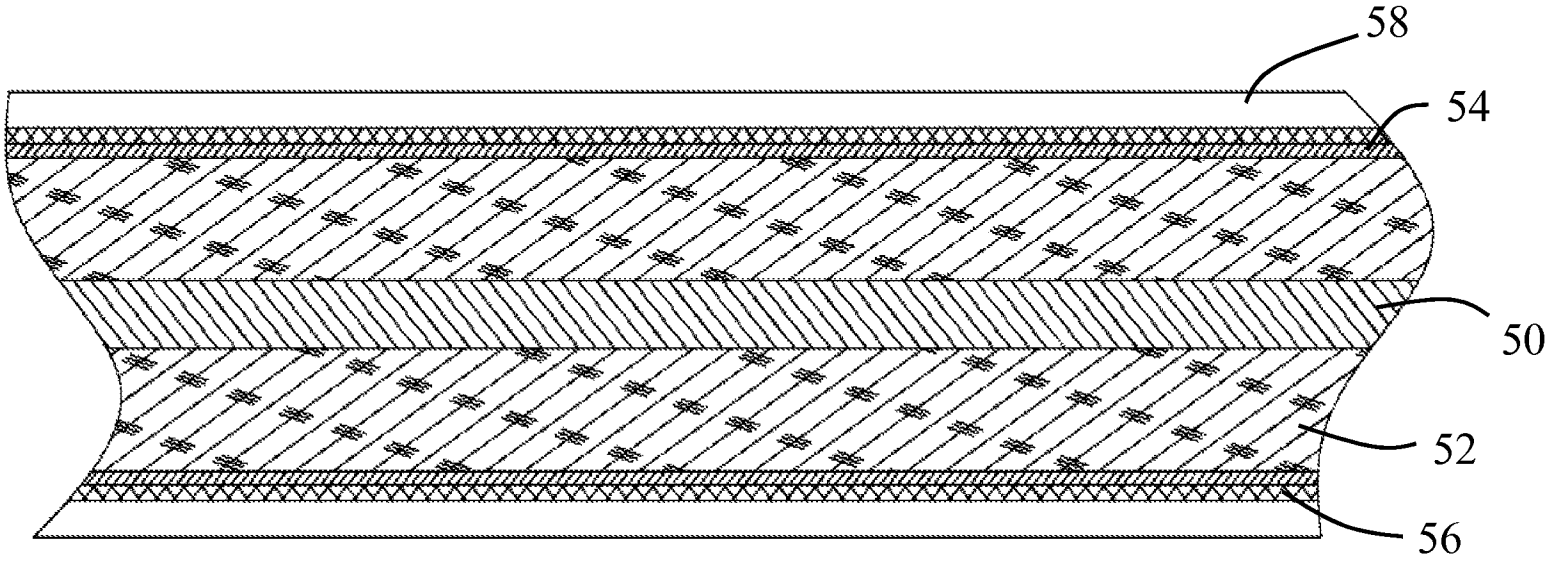
FIG. 3 is sectional view showing a coaxial cable in accordance with the present invention.

FIG. 3 is sectional view showing a coaxial cable in accordance with the present invention. Referring to FIG. 3, the coaxial cable includes a metal wire 50, an insulating layer 52 enclosing the metal wire 50, a metal film 54 enclosing the insulating layer 52, a braid layer 56 enclosing the metal film 54 and a plastic jacket 58 enclosing the braid layer 56. The metal wire 50 may be made of an electrically conductive material, such as copper (Cu), iron (Fe), silver (Ag), nickel (Ni), gold (Au), a copper-gold alloy, a copper-tin alloy, a copper-nickel alloy, an electrically-conductive polymer or an electrically-conductive non-metallic material. The metal film 54 may be an aluminum-containing conductive layer, a copper-containing conductive layer, or another electrically-conductive layer, such as an aluminum foil or copper foil. The metal film 54 may have an electrical shielding effect to avoid signal interference. The braid layer 56 may be double-layered, triple-layered or quadruple-layered conductive metal such as copper or aluminum.

Referring to FIGS. 1 and 2, a front end of the inner sleeve 21 has an outer flange 22, a first interface section 23, and a second interface section 24. A rear end of the inner sleeve 21 has a rearward extending section 25. The rearward extending section 25 has an outer diameter and a wall thickness smaller than those of the second interface section 24. A hole in the inner sleeve 21 extends in an axial direction. A front end of the outer sleeve 26 has an outer sleeve main body 27 embracing the second interface section 24 of the inner sleeve 21. A rear end of the outer sleeve 26 has a rearward extending section 28 radially spaced from the rearward extending section 25. The rearward extending section 28 has an outer diameter and a wall thickness smaller than or equal to those of the outer sleeve main body 27. Alternatively, the rearward extending section 28 has an outer diameter and a wall thickness greater than those of the outer sleeve main body 27. A hole in the outer sleeve 26 extends in the axial direction. The rearward extending section 28 of the outer sleeve 26 coaxially surrounds the rearward extending section 25 of the inner sleeve 21 to define an annular space between the rearward extending section 28 of the outer sleeve 26 and the rearward extending section 25 of the inner sleeve 21. A nut 29 is disposed at a front end of the coaxial cable connector 20. A rear end of the nut 29 has an inner flange 291 freely rotatably sandwiched between the outer flange 22 and the outer sleeve main body 27. A hole in the nut 29 extends in the axial direction. The inner flange 291 has a slopped surface 293 slopping from a radially extending surface 294 of the inner flange 291 to an axially extending surface 295 of the inner flange 291, wherein a slope angle A between the slopped surface 293 and the axial direction may range from 15 to 60 degrees, from 10 to 30 degrees, or preferably from 20 to 45 degrees. The nut 29 is formed with an inner thread 292 configured to engage with an outer thread of the threaded connector 41, and an outer hexagonal section, whereby the coaxial cable connector 20 can be locked to an electronic device via the nut 29 by means of a wrench or the like tool. Alternatively, the nut 29 may be a square nut, circular nut or wing nut.

Figure 8A:
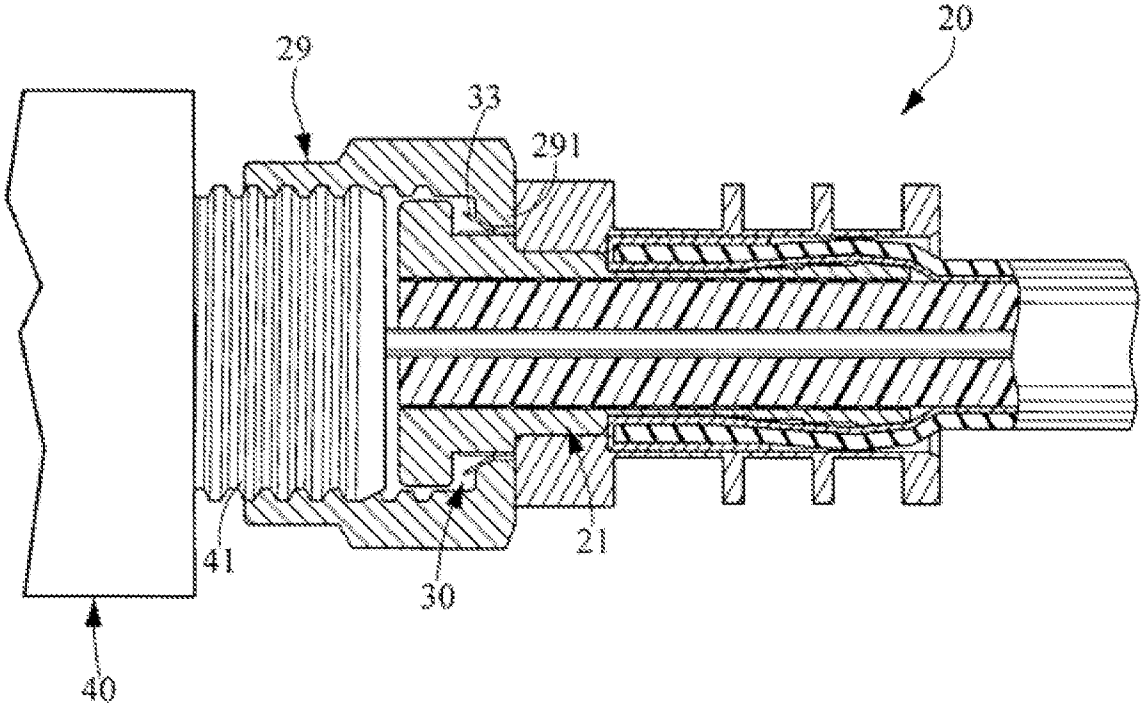
FIGS. 8A and 8B are cross-sectional views showing steps of the coaxial cable connector in accordance with the first embodiment of the present invention being screwed with a threaded connector of an electronic device.
Figure 8B:
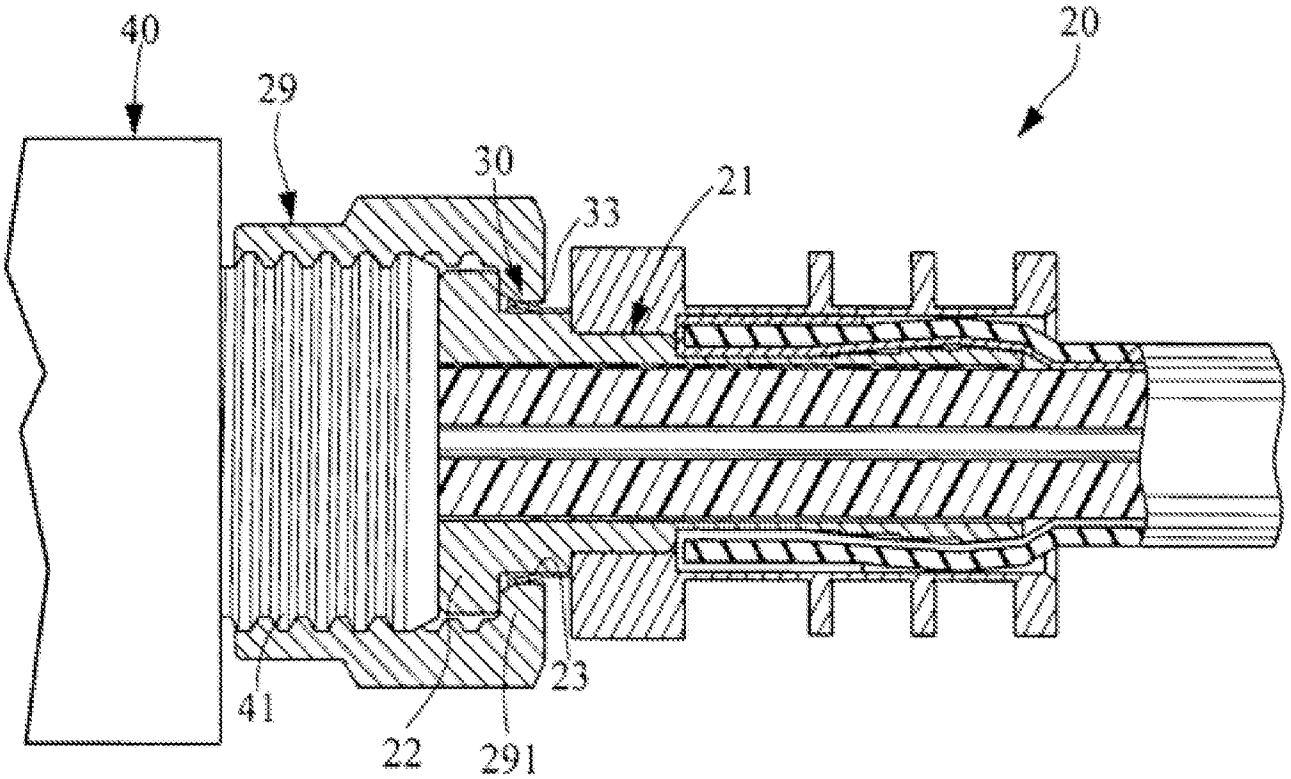

Referring to FIGS. 2 and 4-6, the conductive grounding spring 30 includes an inner annular section 31 defining a hole 32. The hole 32 has such a diameter that the spring 30 can be fitted around the first interface section 23 of the inner sleeve 21 in secure contact with a circumference of the first interface section 23. The conductive grounding spring 30 is provided with one or more cut openings in an annular direction, i.e. four cut openings in this case, each of which may have an arc between 10 and 30 degrees, between 20 and 45 degrees, between 60 and 150 degrees, or between 60 and 120 degrees. The conductive grounding spring 30 further includes multiple plate-like resilient tongue sections 33 formed at an end of the inner annular section 31 at equal intervals. The resilient tongue sections 33 extend from the end of the inner annular section 31 and over the respective cut openings and are outward bent and expanded, in an expanded position, by a predetermined angle B with respect to the axial direction, wherein the expansion angle B may be an acute angle between 10 and 20 degrees, between 15 and 60 degrees, between 20 and 45 degrees or between 30 and 75 degrees, for example, for mechanically contacting with and electrically connecting with the slopped surface 293 or axially extending surface 295 of the inner flange 291 of the nut 29 (as shown in FIG. 2). Accordingly, the coaxial cable connector 20 can be reliably electrically connected with an electronic device 40, as shown in FIGS. 8A and 8B, via the nut 29 so as to ensure good signal transmission quality and good electrical performance.

Referring to FIGS. 2 and 4-6, the conductive grounding spring 30 further includes multiple plate-like outer arcuate sections 34 integrally connected with the inner annular section 31 and positioned between the resilient tongue sections 33. Each neighboring two of the plate-like outer arcuate sections 34 are spaced by corresponding one of the cut openings. When the conductive grounding spring 30 is arranged around the inner sleeve 21, each of the resilient tongue sections 33 may have an outer surface, such as smooth, rough or granular surface, configured to mechanically contact with and electrically connect with the slopped surface 293 or axially extending surface 295 of the inner flange 291 of the nut 29, and the outer arcuate sections 34 and the inner annular section 31 tightly contact with the circumference of the first interface section 23, whereby the conductive grounding spring 30 more securely connects the inner sleeve 21 and the nut 29. Each of the inner annular section 31, plate-like outer arcuate sections 34 and resilient tongue sections 33 may have a thickness between 0.05 and 0.5 mm or between 0.03 and 1 mm. Each of the resilient tongue sections 33 may be expanded with a shape of a rectangular, triangle, semi-circle or polygon.

Figure 7:
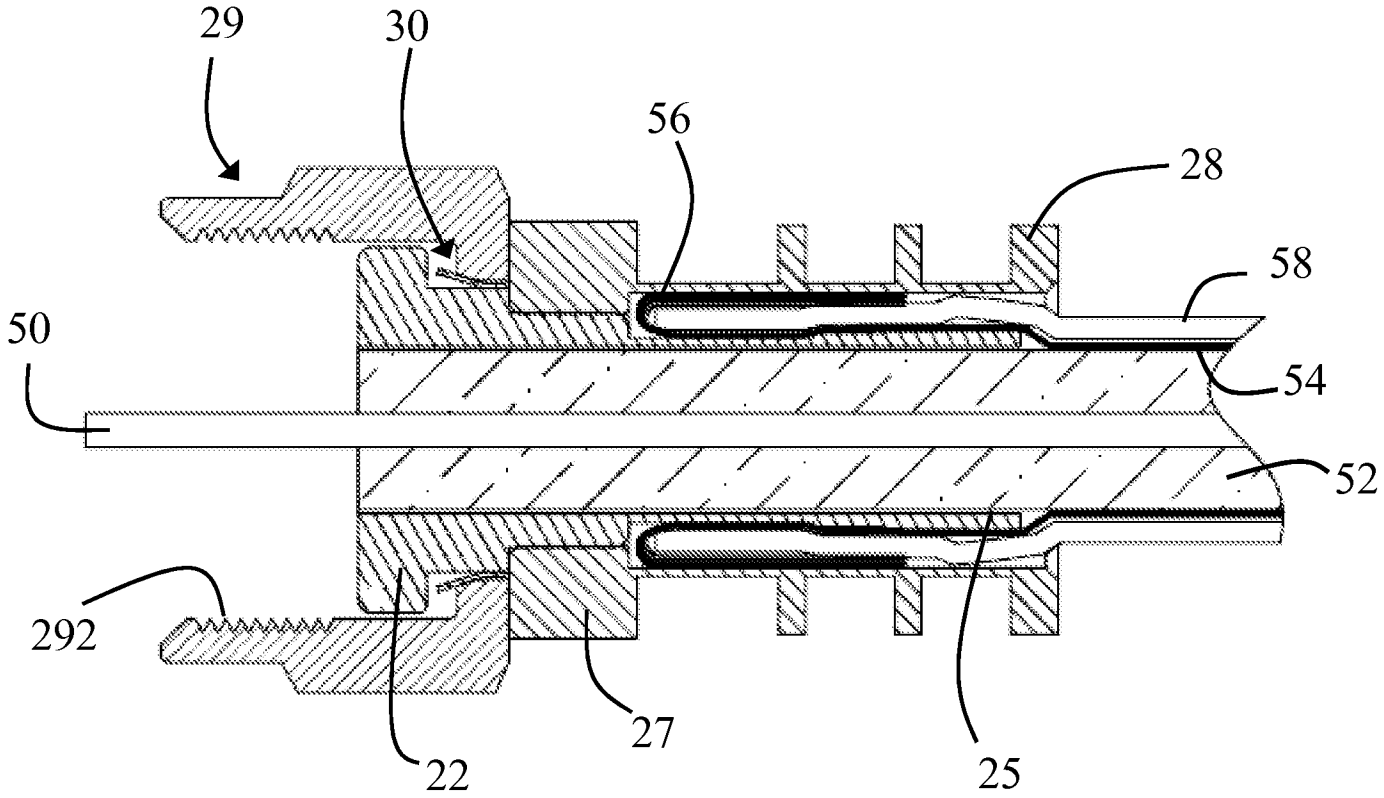
FIG. 7 is a cross-sectional view showing the coaxial cable connector in accordance with the first embodiment of the present invention after secured with a coaxial cable.

Referring to FIG. 7, a method for assembling the coaxial cable connector 20 may include the following steps: (1) passing the rearward extending section 25 of the inner sleeve 21 through the hole 32 at the center of the conductive grounding spring 30 such that the conductive grounding spring 30 may be arranged around the first interface section 23 of the inner sleeve 21; (2) passing the rearward extending section 25 of the inner sleeve 21 through the nut 29 such that the inner flange 291 of the nut 29 may be arranged around the first interface section 23 of the inner sleeve 21 and in contact with the conductive grounding spring 30; (3) passing the rearward extending section 25 of the inner sleeve 21 through the outer sleeve 26 and tightly fitting the outer sleeve main body 27 with the second interface section 24 of the inner sleeve 21, thus the inner sleeve 21 being securely fixed with the outer sleeve 26.

Referring to FIG. 7, before a coaxial cable as illustrated in FIG. 3 is attached to the coaxial cable connector 20, the jacket 58 of the coaxial cable has a front end to be removed therefrom and then the braid layer 56 of the coaxial cable has a front end to be stripped from the metal film 54 of the coaxial cable and to turn back to an opposite surface, i.e. outer surface, of the jacket 58. When the coaxial cable is being attached to the coaxial cable connector 20, the metal wire 50, insulating layer 52 and metal film 54 may be inserted to the hole in the inner sleeve 21, and the rearward extending section 25 of the inner sleeve 21 may cause the braid layer 56 to be separate from the metal film 54 so as to be inserted into a gap between the braid layer 56 and metal film 54 and to lead the jacket 58 and the braid layer 56 having the front end covering the outer surface of the jacket 58 to be inserted into an annular space between the rearward extending section 25 of the inner sleeve 21 and the rearward extending section 28 of the inner sleeve 26. The insulating layer 52 and metal film 54 may have front ends stopping at an end of the hole in the inner sleeve 21. The metal wire 50 has a front end extending to a space surrounded by the inner thread 292 of the nut 29. The rearward extending section 25 of the inner sleeve 21 may be arranged around and in contact with the metal film 54 of the coaxial cable.

FIGS. 8A and 8B show an installation process of the coaxial cable connector 20 to the electronic device 40. Referring to FIGS. 8A and 8B, a method for mounting the coaxial cable connector 20 to the electronic device 40 may include the following steps. First, the hole in the nut 29 of the coaxial cable connector 20 aligns with a threaded connector 41 of the electronic device 40 and the metal wire 50 is inserted into the threaded connector 41. When the nut 29 is being screwed to the threaded connector 41, the outer flange 22 of the inner sleeve 21 may move to the threaded connector 41. At this time, the nut 29 has not yet fully connected with the threaded connector 41 of the electronic device 40. In the coaxial cable connector 20, the nut 29 is in good metal-to-metal contact with the inner sleeve 21 via the resilient tongue sections 33 of the conductive grounding spring 30. Substantially, the resilient tongue sections 33 are outward expanded in contact with the slopped surface 293 of the inner flange 291 of the nut 29. Accordingly, the coaxial cable connector 20 can be reliably electrically connected with the electronic device 40 via the nut 29 as shown in FIG. 8A.

Figure 6:
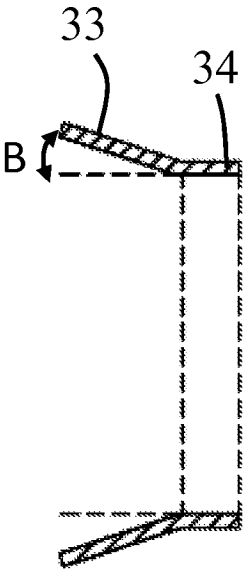
FIG. 6 is a cross-sectional view showing the conductive spring in accordance with the first embodiment of the present invention.
Figure 5:
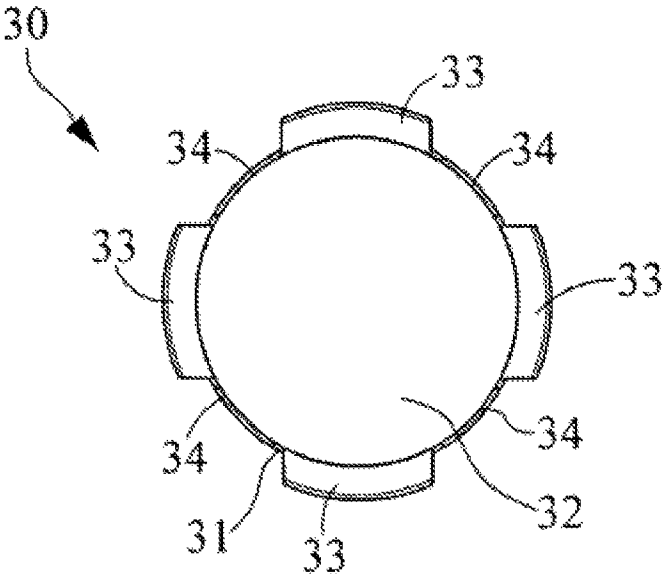
FIG. 5 is a left view showing the conductive spring in accordance with the first embodiment of the present invention.
Figure 4:
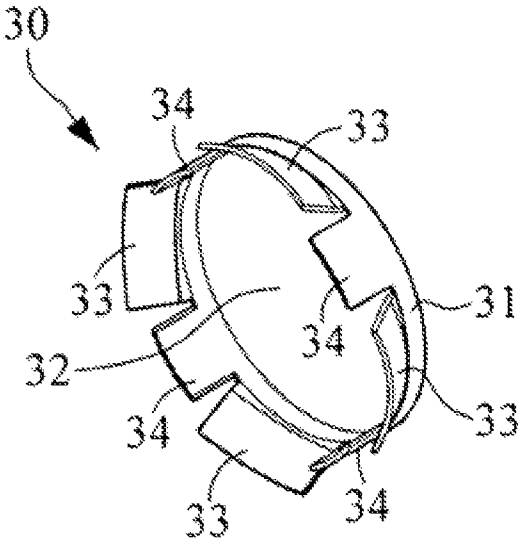
FIG. 4 is a perspective view showing a conductive spring in accordance with the first embodiment of the present invention.

Next, referring to FIGS. 8A and 8B, the nut 29 continues to be being screwed to the threaded connector 41, the outer flange 22 of the inner sleeve 21 may be moved to contact the threaded connector 41. During this time period, the inner flange 291 of the nut 29 continuously presses the resilient tongue sections 33 of the conductive grounding spring 30 such that the angle B as illustrated in FIG. 6 may be gradually reduced.

Afterwards, referring to FIGS. 8A and 8B, the nut 29 may be completely and tightly screwed to the threaded connector 41 such that the outer flange 22 of the inner sleeve 21 has an opposing surface to contact the radially extending surface 294 of the inner flange 291 of the nut 29. At this time, the nut 29 is fully locked onto the threaded connector 41 of the electronic device 40. The resilient tongue sections 33 of the conductive grounding spring 30 are compressed from an outward expanded position (as shown in FIG. 8A) to a contracted position (as shown in FIG. 8B). Eventually, the resilient tongue sections 33 are positioned radially between the inner flange 291 of the nut 29 and the first interface section 23 of the inner sleeve 21. In this case, the conductive grounding spring 30 has the resilient tongue sections 33 always contacting the inner flange 291 of the nut 29 and the inner annular section 31 always contacting the first interface section 23 of the inner sleeve 21. Thereby, the nut 29 is securely electrically connected with the inner sleeve 21 for electrically ground connection. Accordingly, the conductive grounding spring 30 may connect the nut 28 to the inner sleeve 21 for electrical ground connection even when a gap is between the inner sleeve 21 and the threaded connector 41 of the electronic device 40, i.e. the nut 29 is not tightly screwed with the threaded connector 41.

Second Embodiment

Figure 9C:
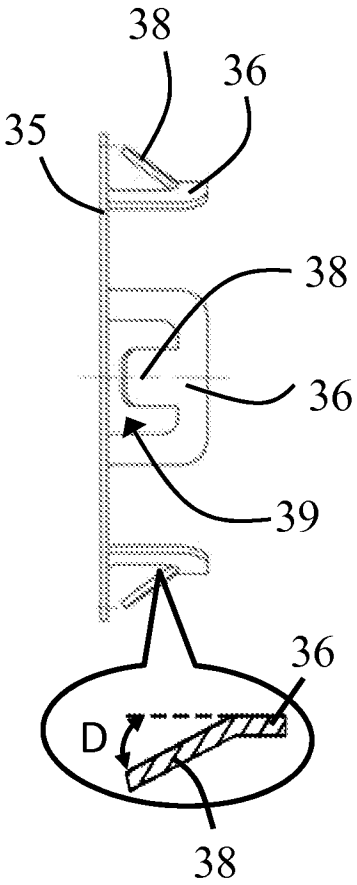
FIGS. 9A, 9B and 9C are perspective, left and top views showing a conductive spring in accordance with a second embodiment of the present invention.
Figure 9B:
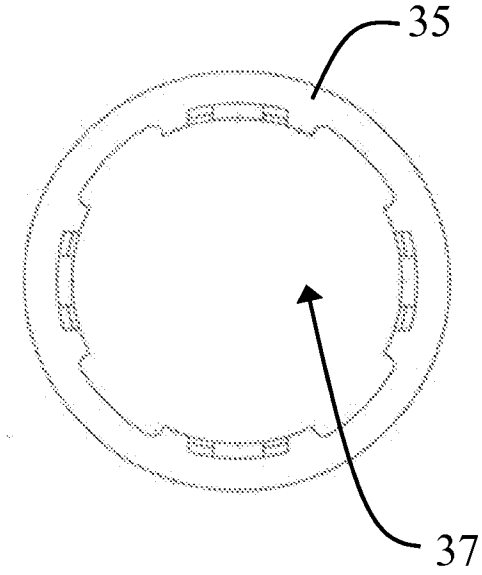
Figure 9A:
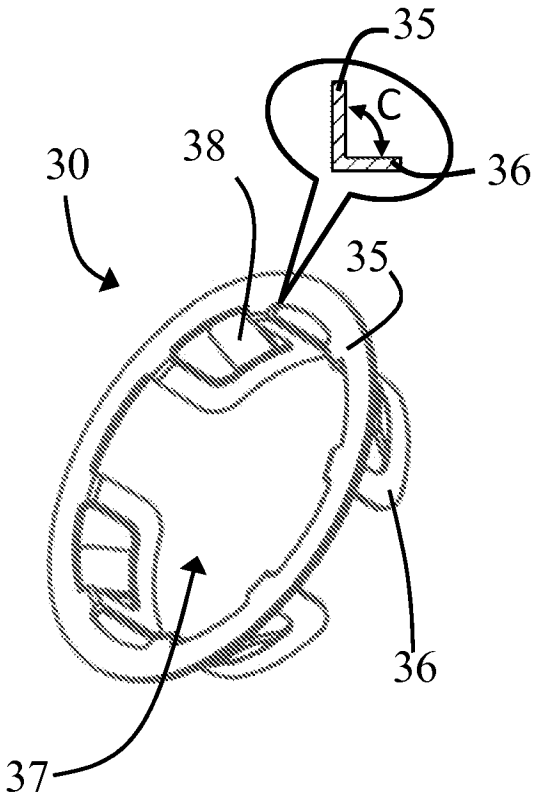

The second embodiment is similar to the first embodiment except that the conductive grounding spring 30 in the second embodiment is different from that of the first embodiment. FIGS. 9A, 9B and 9C are perspective, left and top views showing a conductive spring in accordance with a second embodiment of the present invention. Referring to FIGS. 9A, 9B and 9C, the conductive grounding spring 30 includes an annular plate 35 and one or more U-shaped extension portions 36 integrally formed with the annular plate 35. Each of the U-shaped extension portions 36 may be expanded with a strip extending along three sides of a rectangular, a circumference of a semicircle or multiple sides of a polygon. The U-shaped extension portions 36 may extend from the annular plate 35 at a predetermined angle C such as right angle or another angle between 90 and 120 degrees, between 90 and 100 degrees or between 90 and 95 degrees. Each neighboring two of the U-shaped extension portions 36 are arranged to be separate in an annular direction from each other and a gap in the annular direction may be between neighboring two of the U-shaped extension portions 36. The annular plate 35 may be shaped like a continuous circular ring. Alternatively, the annular plate 35 may be replaced with another plate shaped like a split circular ring with a cut gap, between two ends of the split circular ring, in an annular direction having an arc between 10 and 30 degrees, between 20 and 45 degrees, between 60 and 150 degrees or between 60 and 120 degrees. A hole 32 surrounded by the annular plate 35 may have such a diameter that the spring 30 can be fitted around the first interface section 23 of the inner sleeve 21. The conductive grounding spring 30 is provided with one or more first cut openings in an annular direction, i.e. four first cut openings in this case, each of which may have an arc between 10 and 30 degrees, between 20 and 45 degrees, between 60 and 150 degrees, or between 60 and 120 degrees. Each neighboring two of the U-shaped extension portions 36 are spaced by corresponding one of the first cut openings. The conductive grounding spring 30 is provided with one or more second cut openings 39 in an annular direction, i.e. four second cut openings 39 in this case, each of which may have an arc between 5 and 45 degrees, between 10 and 30 degrees, wherein each of the second cut openings 39 is surrounded by the annular plate 35 and corresponding one of the U-shaped extension portions 36.

Referring to FIGS. 9A, 9B and 9C, the conductive grounding spring 30 may include one or more resilient tabs 38 integrally formed with the U-shaped extension portions 36 and the annular plate 35. Each of the resilient tabs 38 extends from corresponding one of the U-shaped extension portions 36 and over the respective second cut openings 39 and is outward bent and expanded, in an expanded position, by a predetermined angle D with respect to the axial direction, wherein the expansion angle D may be an acute angle between 10 and 20 degrees, between 15 and 60 degrees, between 20 and 45 degrees or between 30 and 75 degrees, for example, for mechanically contacting with and electrically connecting with the slopped surface 293 or axially extending surface 295 of the inner flange 291 of the nut 29 (as shown in FIG. 2). Alternatively, a plurality of the resilient tab 38 may extend from one of the U-shaped extension portions 36 and over one of the second cut openings 39 and may be outward bent and expanded, at an expanded position, by the predetermined angle D.

Referring to FIGS. 9A, 9B and 9C, each of the annular plate 35, U-shaped extension portions 36 and resilient tabs 38 may have a thickness between 0.05 and 0.5 mm or between 0.03 and 1 mm. Each of the resilient tabs 38 may be expanded with a shape of a rectangular, triangle, semi-circle or polygon.

Figure 10:
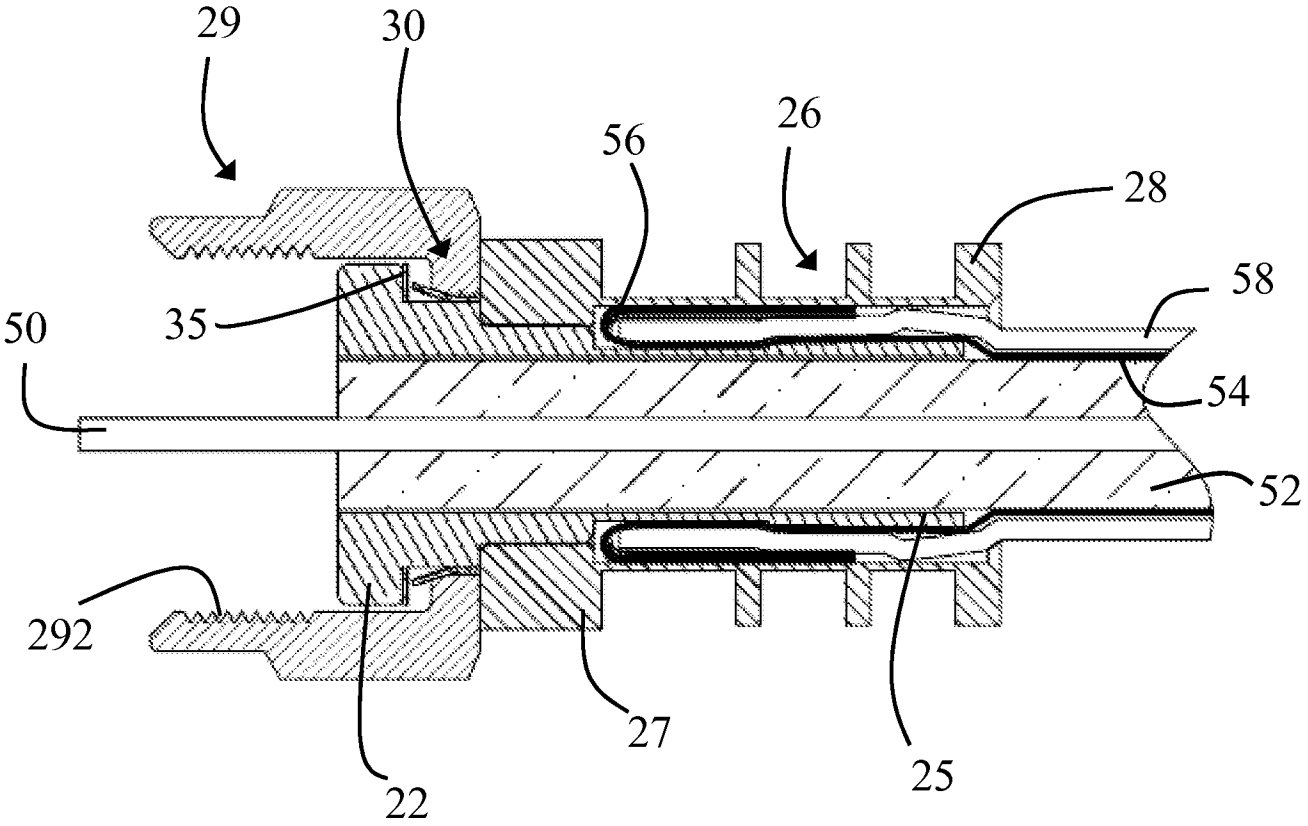
FIG. 10 is a sectional view showing a coaxial cable connector in accordance with the second embodiment of the present invention.

Referring to FIG. 10, a method for assembling the coaxial cable connector 20 may include the following steps: (1) passing the rearward extending section 25 of the inner sleeve 21 through the hole 37 at the center of the conductive grounding spring 30 such that the conductive grounding spring 30 may be arranged around the first interface section 23 of the inner sleeve 21; (2) passing the rearward extending section 25 of the inner sleeve 21 through the nut 29 such that the inner flange 291 of the nut 29 may be arranged around the first interface section 23 of the inner sleeve 21 and in contact with the conductive grounding spring 30; (3) passing the rearward extending section 25 of the inner sleeve 21 through the outer sleeve 26 and tightly fitting the outer sleeve main body 27 with the second interface section 24 of the inner sleeve 21, thus the inner sleeve 21 being securely fixed with the outer sleeve 26. When the conductive grounding spring 30 is arranged around the inner sleeve 21, each of the resilient tabs 38 may have an outer surface, such as smooth, rough or granular surface, configured to mechanically contact with and electrically connect with the slopped surface 293 or axially extending surface 295 of the inner flange 291 of the nut 29 and each of the U-shaped extension portions 36 may tightly contact with the circumference of the first interface section 23, whereby the conductive grounding spring 30 more securely connects the inner sleeve 21 and the nut 29.

The method for attaching the coaxial cable to the coaxial cable connector 20, as illustrated in the first embodiment, may be applied to the second embodiment.

Figure 11A:
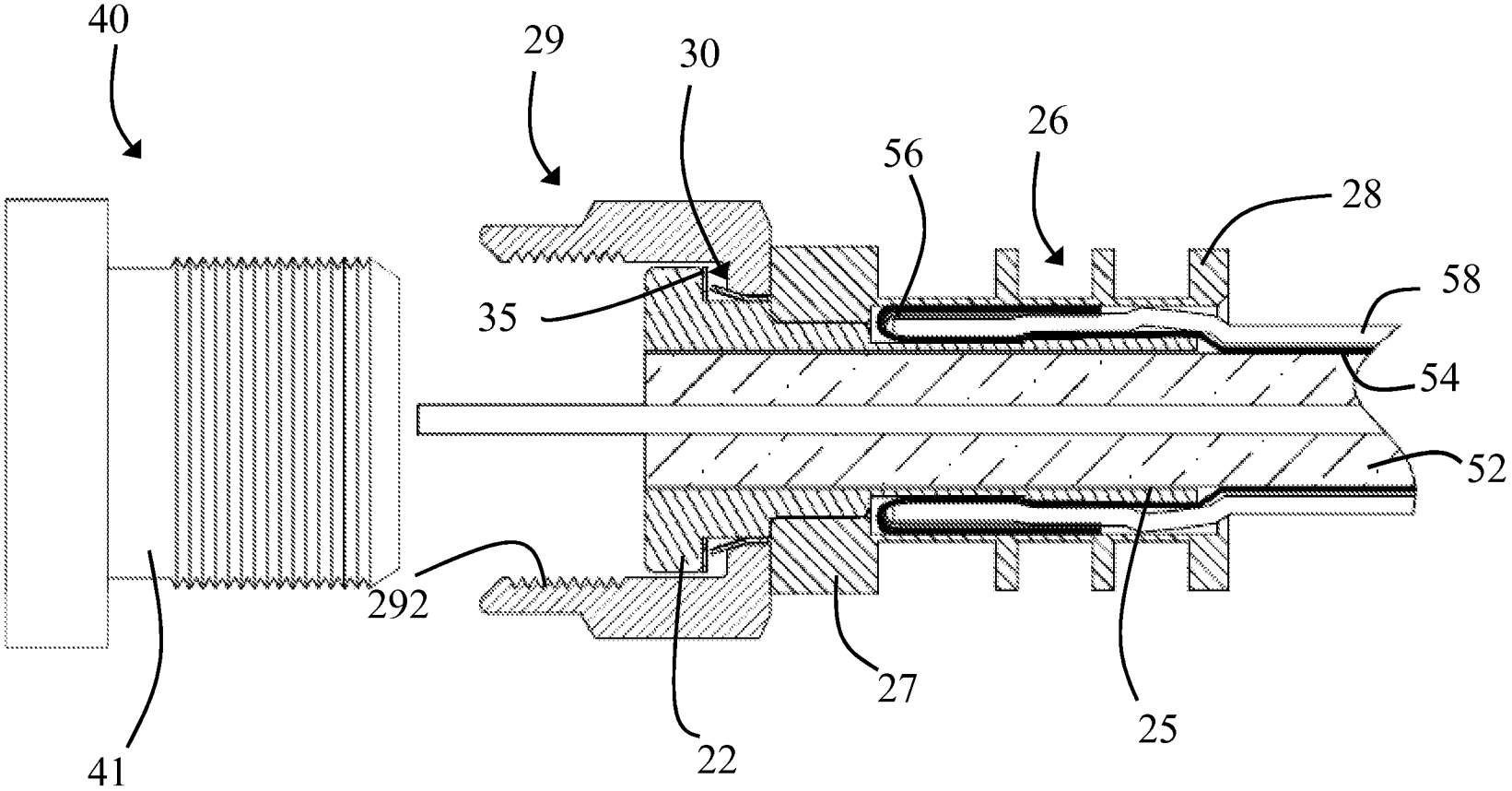
FIGS. 11A and 11B are cross-sectional views showing steps of the coaxial cable connector in accordance with the second embodiment of the present invention being screwed with a threaded connector of an electronic device.
Figure 11B:
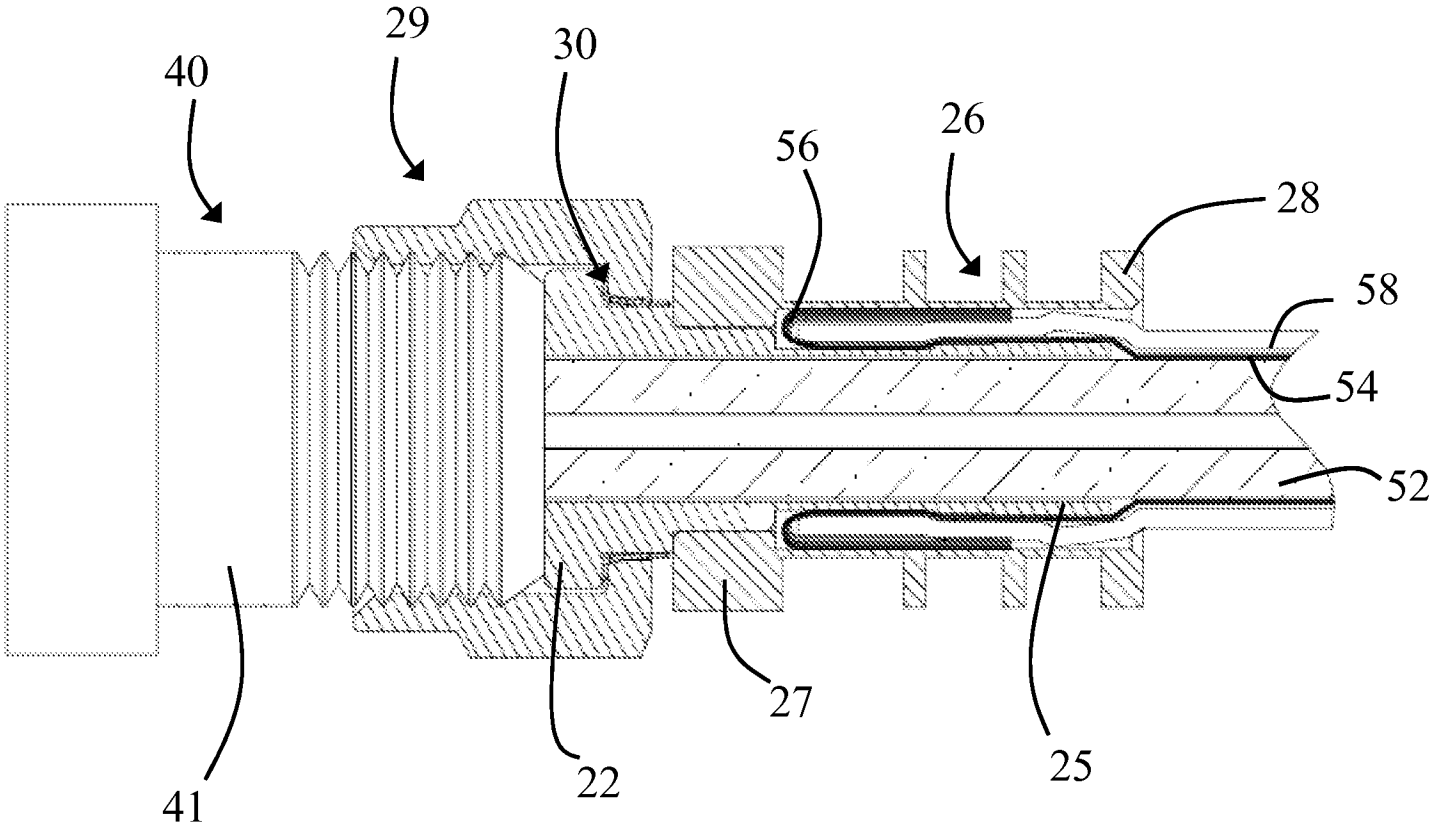

FIGS. 11A and 11B are cross-sectional views showing steps of the coaxial cable connector in accordance with the second embodiment of the present invention being screwed with a threaded connector of an electronic device. Referring to FIGS. 11A and 11B, a method for mounting the coaxial cable connector 20 to the electronic device 40 may include the following steps. First, the hole in the nut 29 of the coaxial cable connector 20 aligns with the threaded connector 41 of the electronic device 40 and the metal wire 50 is inserted into the threaded connector 41. When the nut 29 is being screwed to the threaded connector 41, the outer flange 22 of the inner sleeve 21 may move to the threaded connector 41. At this time, the nut 29 has not yet fully connected with the threaded connector 41 of the electronic device 40. In the coaxial cable connector 20, the nut 29 is in good metal-to-metal contact with the inner sleeve 21 via the resilient tabs 38 of the conductive grounding spring 30. Substantially, the resilient tabs 38 are outward expanded in contact with the slopped surface 293 of the inner flange 291 of the nut 29. Accordingly, the coaxial cable connector 20 can be reliably electrically connected with the electronic device 40 via the nut 29.

Next, referring to FIGS. 11A and 11B, the nut 29 continues to be being screwed to the threaded connector 41, the outer flange 22 of the inner sleeve 21 may be moved to contact the threaded connector 41. During this time period, the inner flange 291 of the nut 29 continuously presses the resilient tabs 33 of the conductive grounding spring 30 such that the angle D as illustrated in FIG. 9C may be gradually reduced.

Afterwards, referring to FIGS. 11A and 11B, the nut 29 may be completely and tightly screwed to the threaded connector 41 such that the annular plate 35 of the conductive grounding spring 30 may be tightly pressed between the radially extending surface 294 of the inner flange 291 of the nut 29 and an opposing surface of the outer flange 22 of the inner sleeve 21. At this time, the nut 29 is fully locked onto the threaded connector 41 of the electronic device 40. The resilient tabs 38 of the conductive grounding spring 30 are compressed from an outward expanded position (as shown in FIG. 11A) to a contracted position (as shown in FIG. 11B). Eventually, the resilient tabs 38 are positioned radially between the inner flange 291 of the nut 29 and the first interface section 23 of the inner sleeve 21. The inner flange 291 of the nut may physically contact the resilient tabs 38, U-shaped extension portions 36 and annular plate 35 of the conductive grounding spring 30. In this case, the conductive grounding spring 30 has the resilient tabs 38 always contacting the inner flange 291 of the nut 29 and the U-shaped extension portions 36 always contacting the first interface section 23 of the inner sleeve 21. Thereby, the nut 29 is securely electrically connected with the inner sleeve 21 for electrically ground connection. Accordingly, the conductive grounding spring 30 may connect the nut 28 to the inner sleeve 21 for electrical ground connection even when a gap is between the inner sleeve 21 and the threaded connector 41 of the electronic device 40, i.e. the nut 29 is not tightly screwed with the threaded connector 41.

The components, steps, features, benefits and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, benefits and advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A spring configured to be attached to a coaxial cable connector configured to be screwed with a threaded connector of an electronic device, wherein said coaxial cable connector comprises an inner sleeve, an outer sleeve arranged coaxially around said inner sleeve with respect to an axis and a nut arranged around said inner sleeve, wherein said nut has an inner thread configured to engage with an outer thread of said threaded connector, wherein said inner sleeve has an outer flange configured to be arranged axially between an inner flange of said nut and said threaded connector of said electronic device, characterized in that:

said spring is configured to be arranged around said inner sleeve, wherein said spring comprises a first resilient tab configured to expand by a first angle from said inner sleeve when said nut is loosely locked to said outer thread of said threaded connector of said electronic device, wherein said first resilient tab is configured to be in a contracted position with a second angle from said inner sleeve less than said first angle, said first resilient tab being configured to be radially between said inner flange and said inner sleeve, when said nut is tightly screwed with said outer thread of said threaded connector of said electronic device, wherein said spring further comprises a plate configured to be arranged physically and axially between said outer flange and said inner flange, wherein said plate is integral with said first resilient tab.

2. The spring of claim 1, wherein said first angle comprises an acute angle facing said plate.

3. The spring of claim 1, wherein said first angle ranges from 30 degrees and 75 degrees.

4. The spring of claim 1, wherein said first resilient tab is configured to abut against a slope surface, slopped to said axis, of said inner flange of said nut when said nut is loosely locked to said outer thread of said threaded connector of said electronic device, wherein said slope surface is slopped from a radially an axially extending surface of said inner flange to a radially extending surface of said inner flange.

5. The spring of claim 1, wherein said first resilient tab is configured to abut against a slope surface, slopped to said axis, of said inner flange of said nut when said nut is loosely locked to said outer thread of said threaded connector of said electronic device, wherein said slope surface is slopped from an axial extending surface of said inner flange to a radially extending surface of said inner flange, wherein an angle between said slope surface and said axis is between 15 degrees and 60 degrees.

6. The spring of claim 1, wherein said first resilient tab has a thickness between 0.05 mm and 0.5 mm.

7. The spring of claim 1, wherein said first resilient tab comprises copper.

8. The spring of claim 1, wherein said first resilient tab comprises tin.

9. The spring of claim 1, wherein said plate is configured to be arranged axially between a first surface of said outer flange and a second surface of said inner flange, wherein said first surface faces substantially in parallel to said second surface.

10. The spring of claim 1 further comprising an extension portion connecting said plate to said first resilient tab, wherein said extension portion, plate and first resilient tab are integral, wherein said first resilient tab extends from said extension portion to expand by said first angle when said nut is loosely locked to said outer thread of said threaded connector of said electronic device.

11. The spring of claim 1 further comprising a second resilient tab integral with said plate and said first resilient tab, wherein said second resilient tab is configured to expand by a third angle from said inner sleeve when said nut is loosely locked to said outer thread of said threaded connector of said electronic device, wherein said second resilient tab is configured to be in said contracted position with a fourth angle from said inner sleeve less than said third angle, said second resilient tab being configured to be radially between said inner flange and said inner sleeve, when said nut is tightly screwed with said outer thread of said threaded connector of said electronic device.

12. The spring of claim 11 further comprising a first extension portion connecting said plate to said first resilient tab and a second extension portion connecting said plate to said second resilient tab, wherein said first and second extension portions, plate and first and second resilient tabs are integral, wherein said first resilient tab extends from said first extension portion to expand by said first angle and said second resilient tab extends from said second extension portion to expand by said third angle when said nut is loosely locked to said outer thread of said threaded connector of said electronic device.

13. The spring of claim 12, wherein said first extension portion is spaced arcuately from said second extension portion.

14. A metal element configured to be attached to a coaxial cable connector configured to be screwed with a threaded connector of an electronic device, wherein said coaxial cable connector comprises an inner sleeve, an outer sleeve arranged coaxially around said inner sleeve and a nut arranged around said inner sleeve, wherein said nut has an inner thread configured to engage with an outer thread of said threaded connector, wherein said inner sleeve has an outer flange configured to be arranged axially between an inner flange of said nut and said threaded connector of said electronic device, characterized in that:

said metal element is configured to be arranged around said inner sleeve, wherein said metal element comprises a plate configured to be arranged physically and axially between said outer flange and said inner flange and a first extension portion configured to be arranged radially between said inner flange and said inner sleeve, wherein said plate is integral with said first extension portion.

15. The metal element of claim 14, wherein said plate has a thickness between 0.05 mm and 0.5 mm.

16. The metal element of claim 14, wherein said plate comprises copper.

17. The metal element of claim 14, wherein said plate comprises tin.

18. The metal element of claim 14, wherein said plate is configured to be arranged axially between a first surface of said outer flange and a second surface of said inner flange, wherein said first surface faces substantially in parallel to said second surface.

19. The metal element of claim 14 further comprising a second extension portion configured to be arranged radially between said inner flange and said inner sleeve, wherein said plate is integral with said first and second extension portions, wherein said first extension portion is spaced arcuately from said second extension portion.

20. A spring configured to be attached to a coaxial cable connector configured to be screwed with a threaded connector of an electronic device, wherein said coaxial cable connector comprises an inner sleeve, an outer sleeve arranged coaxially around said inner sleeve and a nut arranged around said inner sleeve, wherein said nut has an inner thread configured to engage with an outer thread of said threaded connector, wherein said inner sleeve has an outer flange configured to be arranged axially between an inner flange of said nut and said threaded connector of said electronic device, characterized in that:

said spring is configured to be arranged around said inner sleeve, wherein said spring has a first resilient tab configured to extend from a first extension portion of said spring to expand by a first angle from said inner sleeve and a second resilient tab configured to extend from a second extension portion of said spring to expand by a second angle from said inner sleeve when said nut is loosely locked to said outer thread of said threaded connector of said electronic device, wherein said first extension portion is spaced arcuately from said second extension portion, wherein said first resilient tab is configured to be in a contracted position with a third angle from said inner sleeve less than said first angle and said second resilient tab is configured to be in a contracted position with a fourth angle from said inner sleeve less than said second angle, said first and second resilient tabs being configured to be radially between said inner flange and said inner sleeve, when said nut is tightly screwed with said outer thread of said threaded connector of said electronic device.

* * * * *